US011393362B2

(12) United States Patent
Wicki et al.

(10) Patent No.: US 11,393,362 B2
(45) Date of Patent: Jul. 19, 2022

(54) FLOORING SAMPLE TAGGING SYSTEM

(71) Applicant: Christine Wicki, Garland, TX (US)

(72) Inventors: Christine Wicki, Garland, TX (US); Michael Woodford Freitas, Burnet, TX (US)

(73) Assignee: Christine Wicki, Garland, TX (US)

( * ) Notice: Subject to any disclaimer, the term of this patent is extended or adjusted under 35 U.S.C. 154(b) by 114 days.

(21) Appl. No.: 16/272,274

(22) Filed: Feb. 11, 2019

(65) Prior Publication Data

US 2019/0251873 A1 Aug. 15, 2019

Related U.S. Application Data

(60) Provisional application No. 62/629,190, filed on Feb. 12, 2018.

(51) Int. Cl.

| | |
|---|---|
| ***G09F 3/20*** | (2006.01) |
| ***G09F 3/16*** | (2006.01) |
| ***G09F 5/02*** | (2006.01) |
| *G09F 5/04* | (2006.01) |

(52) U.S. Cl.

CPC ..... *G09F 3/201* (2013.01); *G09F 3/16* (2013.01); *G09F 5/02* (2013.01); *G09F 2005/045* (2013.01); *G09F 2005/048* (2013.01)

(58) Field of Classification Search

CPC . G09F 3/201; G09F 3/205; G09F 3/16; G09F 2005/048; G09F 2005/045; Y10T 24/202

USPC ..... 40/316, 658, 666, 660, 661.08

See application file for complete search history.

(56) References Cited

U.S. PATENT DOCUMENTS

| | | | | | |
|---|---|---|---|---|---|
| 1,325,476 | A * | 12/1919 | Kern | G09F 3/20 | 40/652 |
| 1,417,325 | A * | 5/1922 | Hopp | G09F 3/20 | 40/658 |
| 1,765,600 | A * | 6/1930 | McGilvray | A61G 7/05 | 40/660 |
| 5,361,948 | A * | 11/1994 | Batts | A47G 25/485 | 223/91 |
| 7,086,635 | B1 * | 8/2006 | Drapeau | A47F 5/0006 | 206/480 |
| 7,877,916 | B2 * | 2/2011 | Chamandy | G06K 19/07749 | 24/3.12 |

(Continued)

*Primary Examiner* — Gary C Hoge

(74) *Attorney, Agent, or Firm* — Vincent J. Allen; Carstens & Cahoon, LLP

(57) ABSTRACT

A tagging system for carpet or flooring samples has a lower gripping arm, an upper gripping arm, and a connecting arm connecting the lower gripping arm and the upper gripping arm. The lower gripping arm and the lower gripping arm are spaced apart by the connecting arm a distance to provide a snug fit with a typical flooring samples. Disposed on the upper gripping arm is a removeable label window connector, for connecting a transparent label window holder to the upper gripping arm. The label window connector has a plurality of notches about its substantially circular rim for connecting with the label window holder. In another embodiment, the label window connector connects the gripping arms, allowing for mounting the tagger perpendicular to the flooring sample. In another embodiment, the tagger has a body plate receiving a transparent label window, and an arcuate lip for receiving a color-coded marker.

4 Claims, 11 Drawing Sheets

(56) References Cited

U.S. PATENT DOCUMENTS

| | | | | |
|---|---|---|---|---|
| 2003/0159257 | A1* | 8/2003 | Lewis | A41F 9/007<br>24/536 |
| 2014/0259821 | A1* | 9/2014 | Meyerson | G09F 3/06<br>40/316 |

* cited by examiner

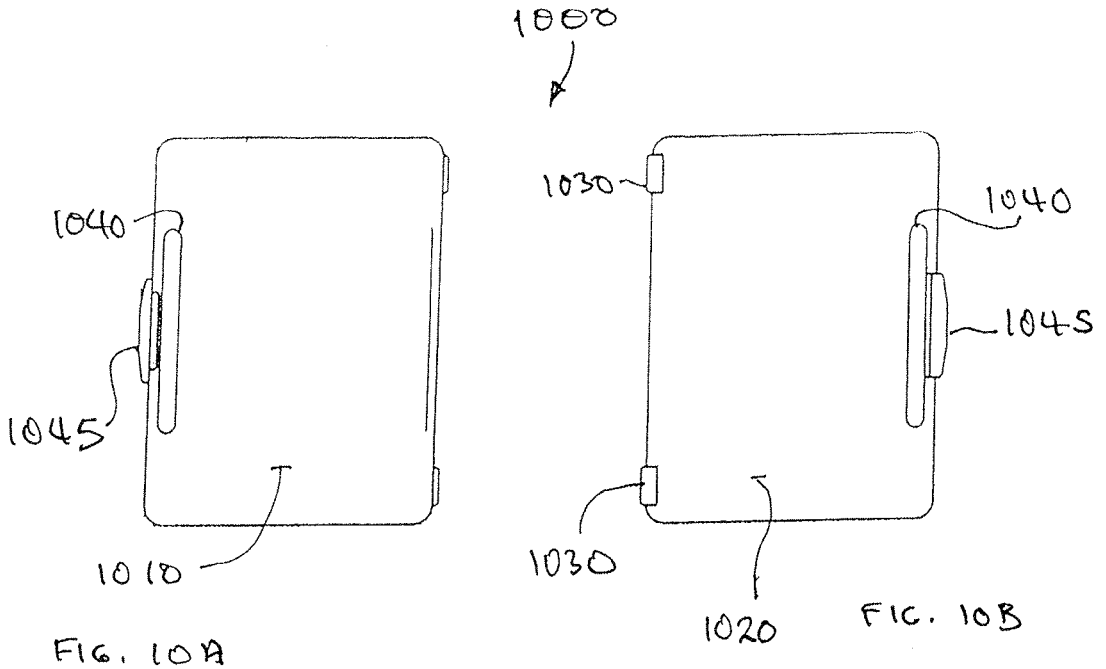
FIG. 10A
FIG. 10B
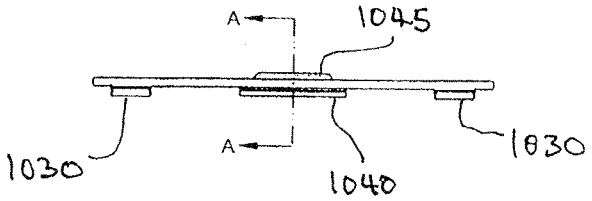
FIG. 10C
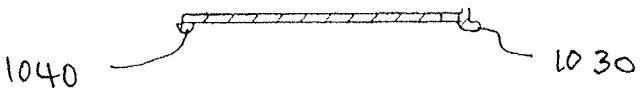
SECTION A-A
FIG. 10D

FLOORING SAMPLE TAGGING SYSTEM

CLAIM FOR PRIORITY

This application claims the priority of U.S. provisional patent application Ser. No. 62/629,190, filed Feb. 12, 2018, the entire disclosure of which is incorporated into the present application by reference.

BACKGROUND

Technical Field

This disclosure is directed to apparatus and systems for tagging carpet samples and similar flooring items so that they may be cataloged and easily located. Such taggers could be conveniently made from plastic or metal. Such items are referred to generally in this application as "taggers."

DRAWINGS

Non-limiting embodiments of the present disclosure are described by way of example in the following drawings, which are schematic and are not intended to be drawn to scale:

Figure 3A:
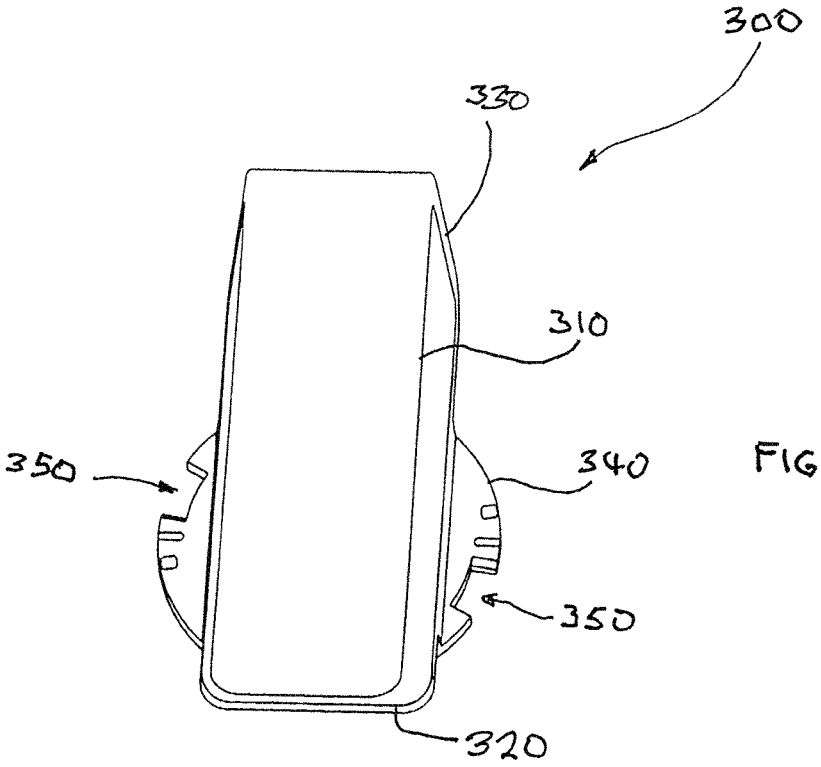
FIGS. 3A and 3B show perspective views of a second embodiment of a tagger.
Figure 3B:
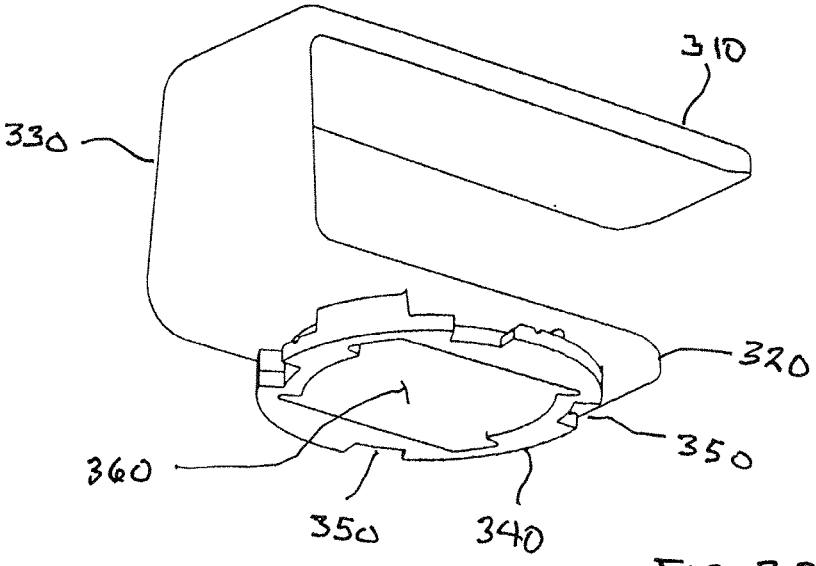
Figure 4A:
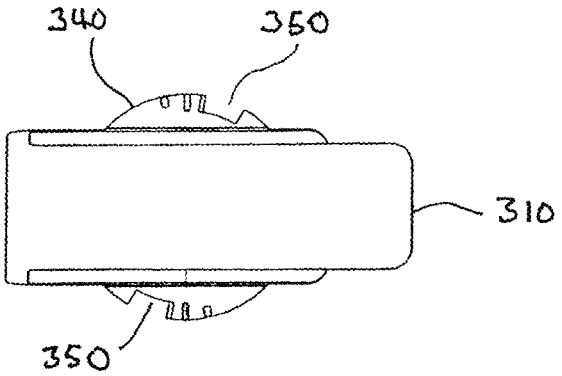
Figure 4B:
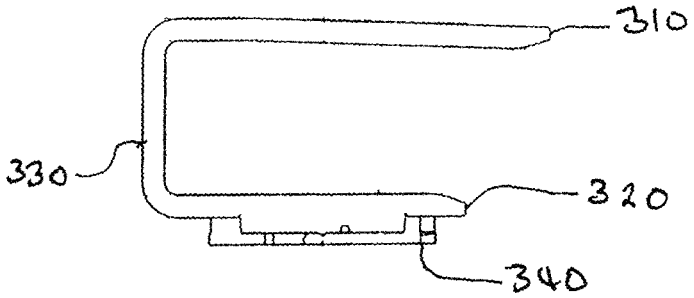
Figure 4C:
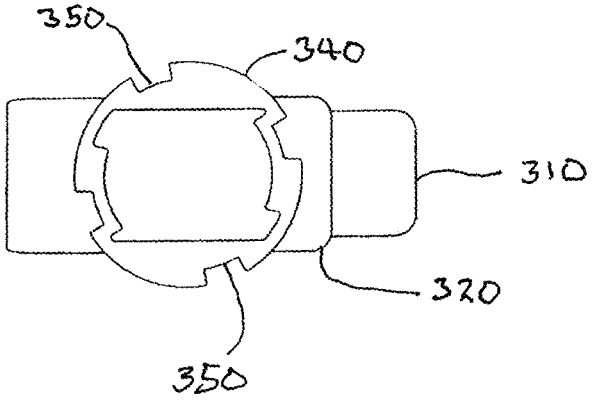

FIGS. 4A, 4B, and 4C show plan views of the embodiment shown in FIGS. 3A and 3B.

Figure 5A:
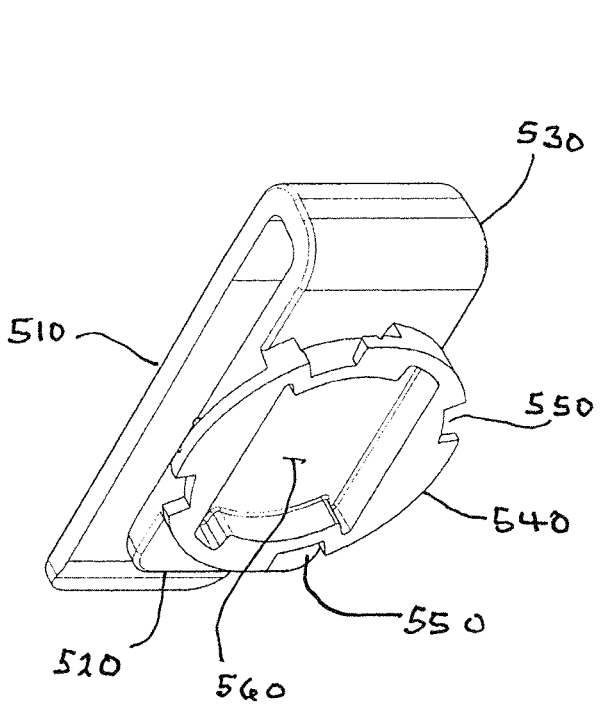
Figure 5B:
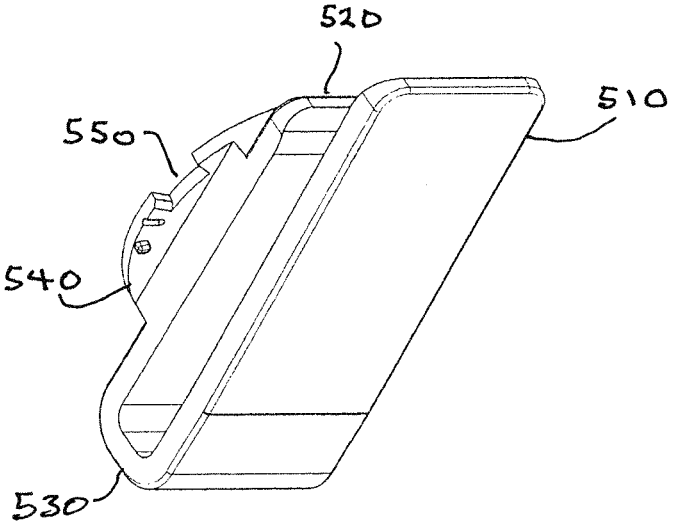

FIGS. 5A and 5B show perspective views of a third embodiment of a tagger.

Figure 6A:
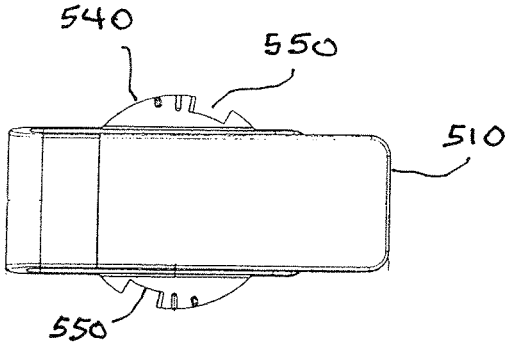
Figure 6B:
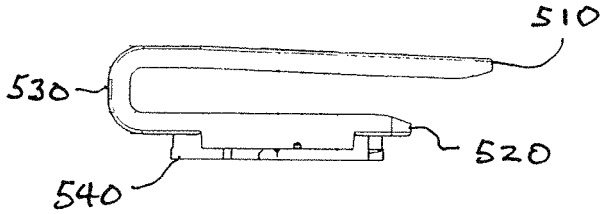
Figure 6C:
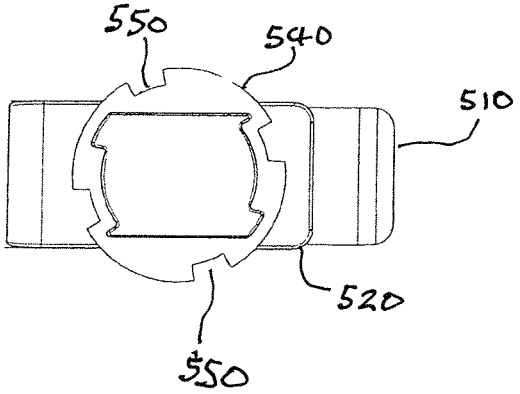

FIGS. 6A, 6B, and 6C show plan views of the embodiment shown in FIGS. 5A and 5B.

Figure 7A:
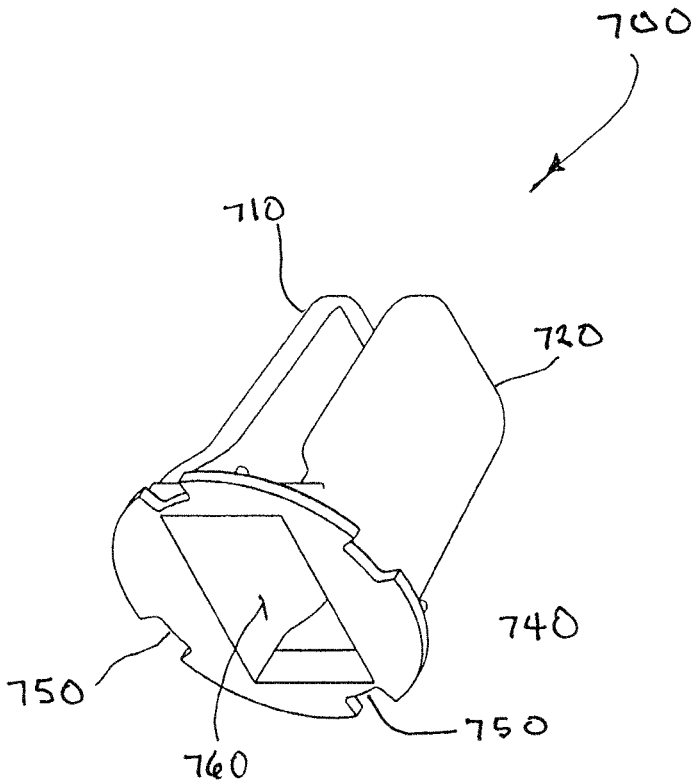
Figure 7B:
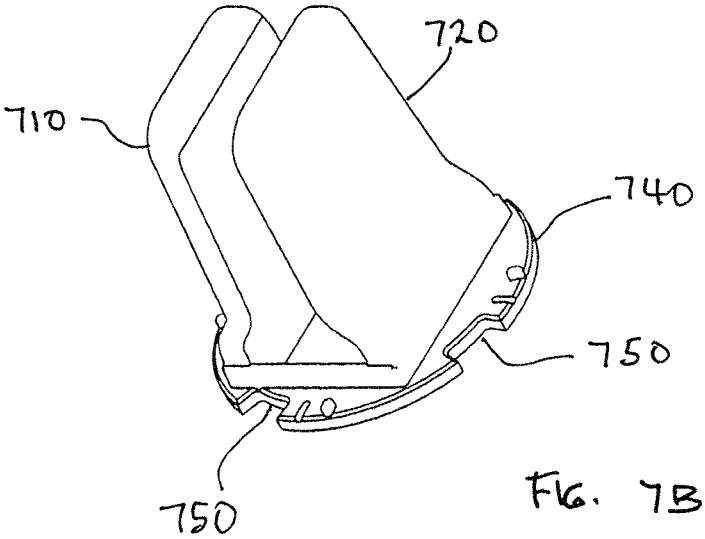

FIGS. 7A and 7B show perspective view of fourth embodiment of a tagger.

Figure 8A:
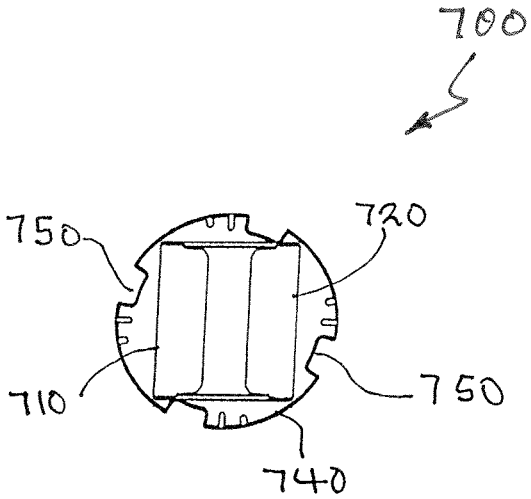
Figure 8B:
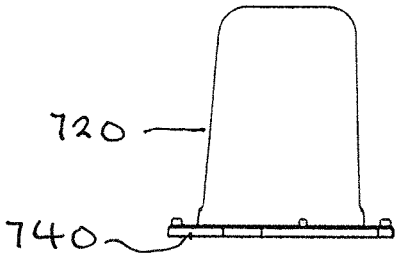
Figure 8C:
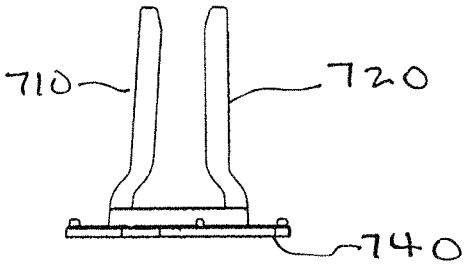

FIGS. 8A, 8B, and 8C show plan views of the embodiment shown in FIGS. 7A and 7B.

Figure 9A:
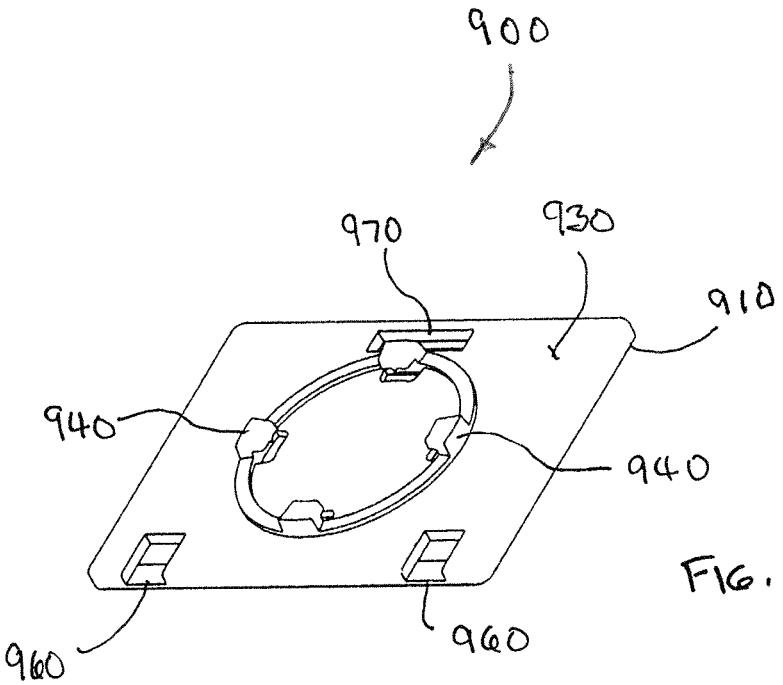
Figure 9B:
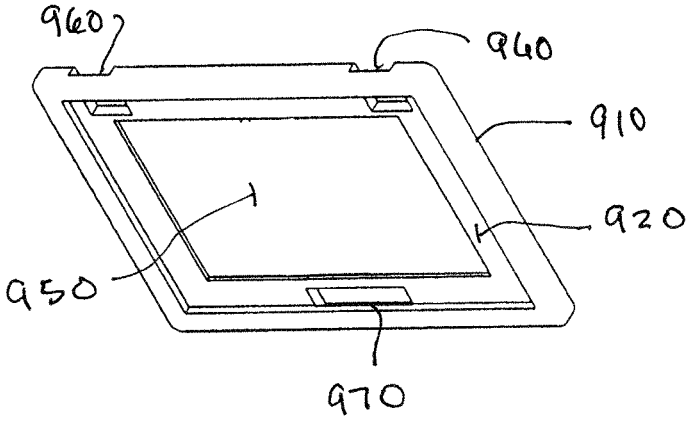

FIGS. 9A and 9B show perspective views of an embodiment of a label for a tagger.

FIGS. 10A, 10B, 10C and 10D show plan views of an embodiment of a transparent label window for a tagger.

Figure 11A:
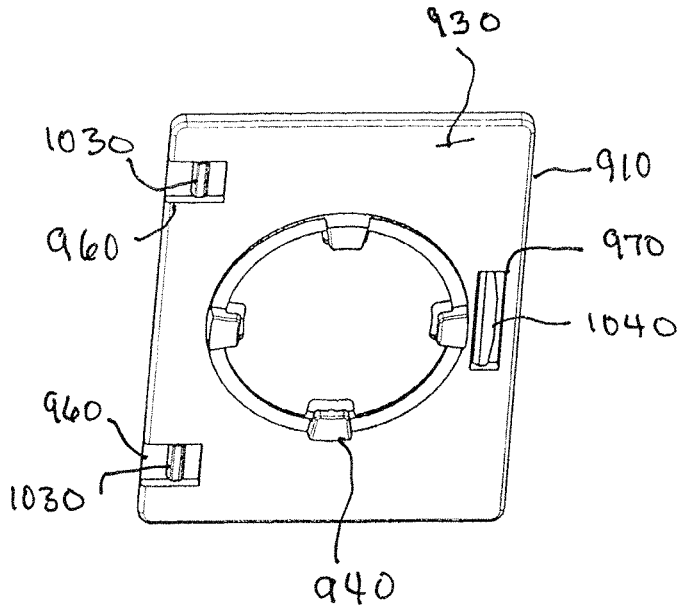
Figure 11B:
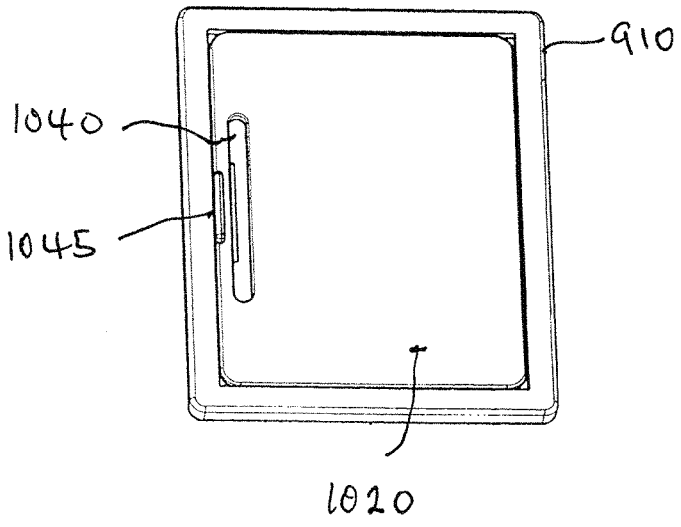

FIGS. 11A and 11B show perspective views of an embodiment of a label assembly for a tagger, assembled from a label and a label window as shown in FIGS. 9A, 9B and 10A-10D.

DESCRIPTION

Embodiments of the claimed improvements are described in the following description in this specification, along with corresponding drawings. The taggers depicted here may be made of plastic or metal, or some combination thereof.

Figure 1A:
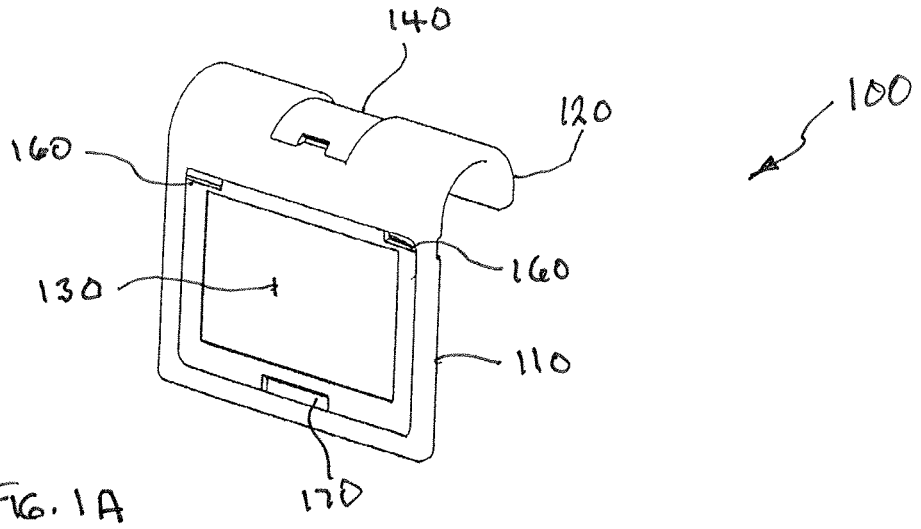
FIGS. 1A and 1B show perspective views of a first embodiment of a tagger.
Figure 1B:
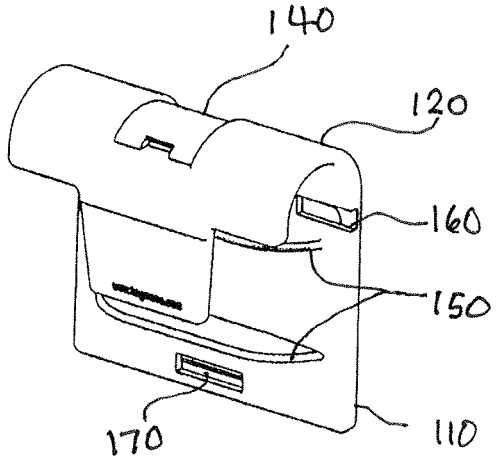
Figure 1C:
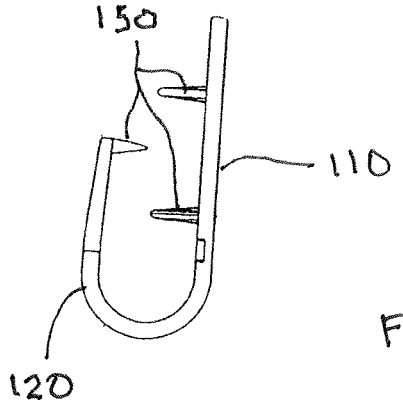
FIG. 1C is a side view of the same embodiment.

A first embodiment 100 of a tagger is shown in FIG. 1 and FIG. 2. This first embodiment 100 is adapted for use with soft carpet samples, usually, a single layer of carpet. FIGS. 1A-1B depict the first embodiment 100 in perspective view, and FIG. 1C depicts the first embodiment 100 in side plan view. The first embodiment 100 comprises a body plate 110, which body plate 110 is integral with an arcuate lip 120 that can curve about the carpet sample. Interior to the arcuate lip 120, ridges 150 are disposed on the plate 110 for gripping a carpet sample. The body plate 110 preferably has a label window holder 130 recessed into the surface of the body plate 110, wherein a transparent label window 1000 (described below) can be snap-fitted. The body plate 110 has at least one first indentation 160 along a first edge of recessed label window holder 130, and at least one second indentation 170 along the opposite edge thereof for receiving a transparent label window 1000, in the manner describe more fully below.

The arcuate lip 120 of the first embodiment also preferably has an outward-facing recess 140 to receive an identification marker 200, preferably color-coded, so that the carpet sample held by the first embodiment can be identified when placed in a stack of similar samples.

Figure 2A:
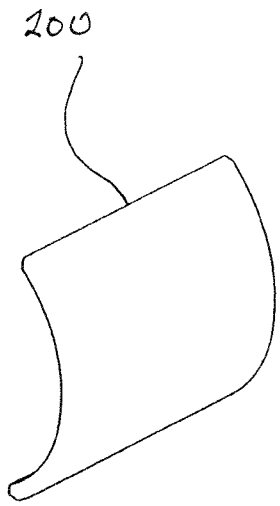
FIGS. 2A and 2B show perspective views of a label window for the embodiment shown in FIGS. 1A and 1B.
Figure 2B:
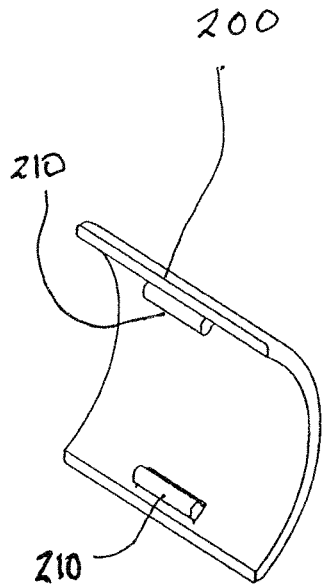
Figure 2C:
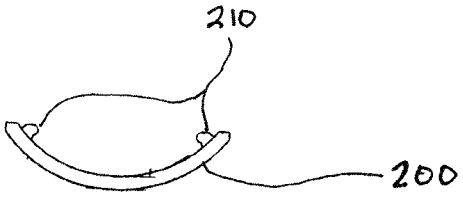
FIG. 2C is a side view of the same window.

FIGS. 2A and 2B show the identification marker 200 associated with the first embodiment 100. The identification marker 200 has a generally arcuate shape to correspond with the arcuate lip 120 of the first embodiment 100, so that the arcuate lip 120 can receive the identification marker 200 in a snap fit. Such a snap fit may be enabled by grips 210 on the inward side of the arcuate curve of the identification marker 200, as shown in FIG. 2C. Preferably, the identification marker 200 may be color-coded so that particular samples held by the first embodiment may be identified and distinguished.

A second embodiment 300 of the tagger is shown in FIGS. 3 and 4. This second embodiment 300 is adapted to be placed about sections of wood flooring. FIGS. 3A and 3B show perspective views of the second embodiment 300, and FIGS. 4A, 4B, and 4C show, respectively, top, side, and plan views of the second embodiment 300.

The second embodiment 300 has generally a lower gripping arm 310, and an upper gripping arm 320, and a connecting arm 330 connecting the lower gripping arm 310 and the upper gripping arm 320. The lower gripping arm 310 and the upper gripping arm 320 are spaced apart by the connecting arm 330 a distance to provide a snug fit with a typical wood flooring sample. Disposed on the upper gripping arm 320 of the second embodiment 300 is a label window connector 340, for connecting a label window holder 900 (discussed below) to the upper gripping arm 320. The label window connector 340 has a plurality of notches 350 about its substantially circular rim, for connecting with a label window holder 900. (The label window connector 340 may have a recess 360 formed as part of a manufacturing process and shown in the figures, but the recess 360 is not relevant to the claims of this disclosure.)

A third embodiment 500 of the tagger is shown in FIGS. 5 and 6. This third embodiment 500 is adapted to be placed about samples of hard-surface flooring other than wood flooring. FIGS. 5A and 5B show perspective views of the third embodiment 500, and FIGS. 6A, 6B, and 6C show, respectively, top, side, and plan views of the third embodiment 500.

The third embodiment 500 has generally a lower gripping arm 510, and an upper gripping arm 520, and a connecting arm 530 connecting the lower gripping arm 510 and the upper gripping arm 520. The lower gripping arm 510 and the upper gripping arm 520 are spaced apart by the connecting arm 530 a distance to provide a snug fit with a typical hard-surface flooring sample. Disposed on the upper gripping arm 520 of the third embodiment 500 is a label window connector 540, for connecting a label window holder 900 (discussed below) to the upper gripping arm 520. The label window connector 540 has a plurality of notches 550 about its substantially circular rim, for connecting with a label window holder 900. (The label window connector 540 may have a recess 560 formed as part of a manufacturing process and shown in the figures, but the recess 560 is not relevant to the claims of this disclosure.)

A fourth embodiment 700 of the tagger is shown in FIGS. 7 and 8. This fourth embodiment 700 is adapted to be placed about samples of hard-surface flooring other than wood flooring, similar to the third embodiment above, but in this case where the sample is stored and displayed vertically. FIGS. 7A and 7B show perspective views of the fourth embodiment 700, and FIGS. 8A, 8B, and 8C show, respectively, top, side, and plan views of the third embodiment 700.

The fourth embodiment 700 has generally a lower gripping arm 710, and an upper gripping arm 720. The lower gripping arm 710 and the upper gripping arm 720 are spaced apart by a label window connector 740 a distance sufficient to provide a snug fit with a typical hard-surface flooring sample. The label window connector 740 is adapted for connecting a label window holder 900 to the fourth embodiment 700. The label window connector 740 has a plurality of notches 750 about its substantially circular rim, for connecting with a label window holder 900 described next. (The label window connector 740 may have a recess 760 formed as part of a manufacturing process and shown in the figures, but the recess 760 is not relevant to the claims of this disclosure.) In this fourth embodiment, therefore, the plane of the label window holder 900 is perpendicular to the plane of the flooring held between the lower gripping arm 710 and the upper gripping arm 720.

FIGS. 9A and 9B show in perspective a label window holder 900 adapted to be connected to any of the second, third, or fourth embodiments described above. The label window holder has a holder plate 910; the holder plate 910 having a front side 920 and a rear side 930. The rear side 910 of the holder plate 910 has fingers 940 sized to engage the notches 350 of the second embodiment 300, or the notches 550 of the third embodiment 500, or the notches 750 of the fourth embodiment, as the case may be, when the holder plate 910 is positioned against one of the label window connectors 340, 540, or 740 described above and twisted to engage any of the respective notches 350, 550, or 750 of the same.

The front side 920 of the label window holder 900 has a recess 950 for receiving a transparent label window 1000 (described following) by snap fit. The front side 920 of the label window holder 900 has at least one first indention 960 along a first edge thereof and at least one second indention 970 along the opposite edge thereof for receiving a transparent label window 1000).

In intended use, the label window holder 900 would be provided with a printed label describing the flooring which it holds, where the printed label (not shown) is placed within the recess 950 thereof. Preferably, the printed label is protected against damage by a transparent label window 1000, as shown in FIGS. 10A-10D. FIG. 10A shows a typical front surface 1010 of the transparent label window 1000, and FIG. 10B shows the reverse side 1020 of the transparent label window 1000. On the reverse side, along a first edge of the transparent label window 1000, is at least one first protrusion 1030 for engaging with the first indentations 960 in the label window holder 900. On the reverse side, along a second edge of the transparent label window 1000 is at least one second protrusion 1040, for engaging with the second indentation 970 of the label window holder 900, so that the transparent label window 1000 may snap fit into the label window holder 900 and cover any printed material therein.

Further, the transparent label window 1000, scaled in size appropriately, may snap fit into the label window 130 described in connection with the first embodiment above.

FIGS. 11A and 11B show an assembly 1100 of a label window holder 900 and a transparent label window 1000, where FIG. 11A is a perspective view of the front side 1110 of such an assembly 1100 and FIG. 11B is the rear side 1120 of such an assembly 1100.

None of the description in this application should be read as implying that any particular element, step, or function is an essential element which must be included in the claim scope; the scope of patented subject matter is defined only by the allowed claims. Moreover, none of these claims are intended to invoke 35 U.S.C. Section 112(f) unless the exact words "means for" are used, followed by a gerund. The claims as filed are intended to be as comprehensive as possible, and no subject matter is intentionally relinquished, dedicated, or abandoned.

We claim:

1. A tagger for carpet samples, comprising:

a body plate;

an arcuate lip; the arcuate lip integral with the body plate; the body plate and the arcuate lip rigidly fixed with respect to one another;

the opening of the arcuate lip sized to accommodate a carpet sample;

the body plate further comprising a label window holder;

the arcuate lip further comprising an outward-facing recess; and, a identification marker; the identification marker further having an arcuate curve adapted to fit the identification marker within the outward-facing recess of the arcuate lip;

the identification marker secured in the outward-facing recess such that it is fastened with respect to the arcuate lip.

2. The tagger for carpet samples of claim 1, further comprising:

a transparent label window;

the transparent label window sized to fit within the label window holder.

3. The tagger for carpet samples of claim 1, where the identification marker has an inward side; at least two grips are located along the identification marker's inward side and are opposite each other, wherein the at least two grips fasten the identification marker to a recessed surface on the outward-facing recess.

4. The tagger for carpet samples of claim 1, further comprising:

at least one upper ridge located on an under surface of the body plate, wherein the at least one upper ridge splits in between a plurality of fibers on the carpet; and an at least one lower ridge located on a lower surface of the acuate lip, wherein the at least one lower ridge provides pressure on the bottom surface of the carpet sample to hold the carpet sample in place.

* * * * *